US011585032B2

(12) United States Patent
Masters et al.

(10) Patent No.: US 11,585,032 B2
(45) Date of Patent: Feb. 21, 2023

(54) LAUNDRY TREATING APPLIANCE AND METHOD OF OPERATION

(71) Applicant: WHIRLPOOL CORPORATION, Benton Harbor, MI (US)

(72) Inventors: Roy E. Masters, Saint Joseph, MI (US); Arun Rajendran, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/832,027

(22) Filed: Mar. 27, 2020

(65) Prior Publication Data

US 2020/0224358 A1 Jul. 16, 2020

Related U.S. Application Data

(63) Continuation of application No. 14/974,000, filed on Dec. 18, 2015, now Pat. No. 10,648,125.

(51) Int. Cl.

| | |
|---|---|
| ***D06F 29/00*** | (2006.01) |
| ***D06F 58/30*** | (2020.01) |
| *D06F 58/24* | (2006.01) |
| *D06F 103/08* | (2020.01) |
| *D06F 58/20* | (2006.01) |

(52) U.S. Cl.

CPC ..... *D06F 29/005* (2013.01); *D06F 58/30* (2020.02); *D06F 58/203* (2013.01); *D06F 58/206* (2013.01); *D06F 58/24* (2013.01); *D06F 2103/08* (2020.02)

(58) Field of Classification Search

CPC ..... D06F 58/203; D06F 58/02; D06F 58/206; D06F 58/22; D06F 29/005; D06F 58/24; D06F 58/28; D06F 2058/2803; D06F 2058/2819; D06F 58/30; D06F 58/38; D06F 2103/08

USPC ..... 34/389

See application file for complete search history.

(56) References Cited

U.S. PATENT DOCUMENTS

| | | | | |
|---|---|---|---|---|
| 2,672,024 | A | 3/1954 | McGrath | |
| 5,711,819 | A * | 1/1998 | Miyasaki | B08B 3/00 134/11 |
| 8,182,612 | B2 | 5/2012 | Grunert | |
| 8,857,071 | B2 | 10/2014 | Lee et al. | |
| 9,134,067 | B2 | 9/2015 | Hosotani | |

(Continued)

FOREIGN PATENT DOCUMENTS

| | | | |
|---|---|---|---|
| DE | 112012006737 | T5 | 4/2015 |
| EP | 0743389 | A1 | 11/1996 |

(Continued)

OTHER PUBLICATIONS

European Search Report for Counterpart EP16199223.5, dated Feb. 15, 2017.

*Primary Examiner* — Edelmira Bosques
*Assistant Examiner* — Bao D Nguyen
(74) *Attorney, Agent, or Firm* — McGarry Bair PC

(57) ABSTRACT

A method of operating a laundry treating appliance having a drum, and an air conduit fluidly coupled to the drum, with a heat source associated with the air conduit, includes moving air through an air conduit to the drum; heating the moving air by operating the heat source; and introducing atomized liquid into the air conduit upstream of the heat source.

25 Claims, 5 Drawing Sheets

(56) References Cited

U.S. PATENT DOCUMENTS

| | | | | |
|---|---|---|---|---|
| 2005/0204755 | A1* | 9/2005 | Nishiwaki | D06F 58/206 62/93 |
| 2009/0071032 | A1* | 3/2009 | Kreutzfeldt | D06F 58/44 34/526 |
| 2010/0146809 | A1 | 6/2010 | Grunert et al. | |
| 2011/0277334 | A1 | 11/2011 | Lee et al. | |
| 2012/0246960 | A1* | 10/2012 | Lee | D06F 58/22 34/86 |
| 2014/0075682 | A1* | 3/2014 | Filippetti | A47L 15/16 8/137 |
| 2015/0259848 | A1 | 9/2015 | Frank et al. | |
| 2016/0083896 | A1* | 3/2016 | Ryoo | D06F 25/00 68/20 |

FOREIGN PATENT DOCUMENTS

| | | | |
|---|---|---|---|
| EP | 2341178 | A1 | 7/2011 |
| EP | 2478969 | A1 | 7/2012 |
| EP | 2662486 | A1 | 11/2013 |
| ES | 2396452 | T3 | 2/2013 |
| FR | 2954782 | A1 | 7/2011 |
| JP | 2009178481 | A | 8/2009 |
| KR | 101549861 | B1 | 9/2015 |
| WO | 2015074837 | A1 | 5/2015 |

* cited by examiner

LAUNDRY TREATING APPLIANCE AND METHOD OF OPERATION

CROSS-REFERENCE TO RELATED APPLICATIONS

This application is a continuation of U.S. patent application Ser. No. 14/974,000, filed Dec. 18, 2015, now U.S. Pat. No. 10,648,125, issued May 12, 2020, which is incorporated herein by reference in its entirety.

BACKGROUND OF THE INVENTION

Contemporary laundry treating appliances, such as clothes dryers, may be provided with a treating chamber for receiving a laundry load for treatment, such as drying, and a heating element for heating the air to treat the laundry load. Contemporary laundry treating appliances can include clothes dryers that utilize a heat source, to heat air forced through the clothes dryer to dry a load of washed clothes. Contemporary laundry treating appliances, such as clothes dryers, may have a configuration based on a rotating drum that defines a treating chamber in which laundry items are placed for treating according to a cycle of operation. A controller may be operably connected with the air conduit and may have various components of the laundry treating appliance to execute the cycle of operation. The cycle of operation may be selected manually by the user or automatically based on one or more conditions determined by the controller.

SUMMARY

One aspect of the invention is a method of operating a laundry treating appliance comprised of a drum, and an air conduit fluidly coupled to the drum. A heat source is associated with the air conduit. The method comprises moving the air through the air conduit, heating the air by operating the heat source, and introducing atomized liquid into the air conduit upstream of the heat source wherein the heat from the heat source heats the air and atomized liquid prior to the introduction of the air containing atomized liquid into the drum.

Another aspect of the invention is a laundry treating appliance comprising a drum defining a treating chamber that is fluidly coupled to an air conduit. A blower forces air through the air conduit. A heat source is associated with the air conduit and an atomizer fluidly coupled to the air conduit upstream of the heat source wherein the atomizer is configured to introduce atomized liquid into the air conduit.

DESCRIPTION OF EMBODIMENTS OF THE INVENTION

Figure 1:
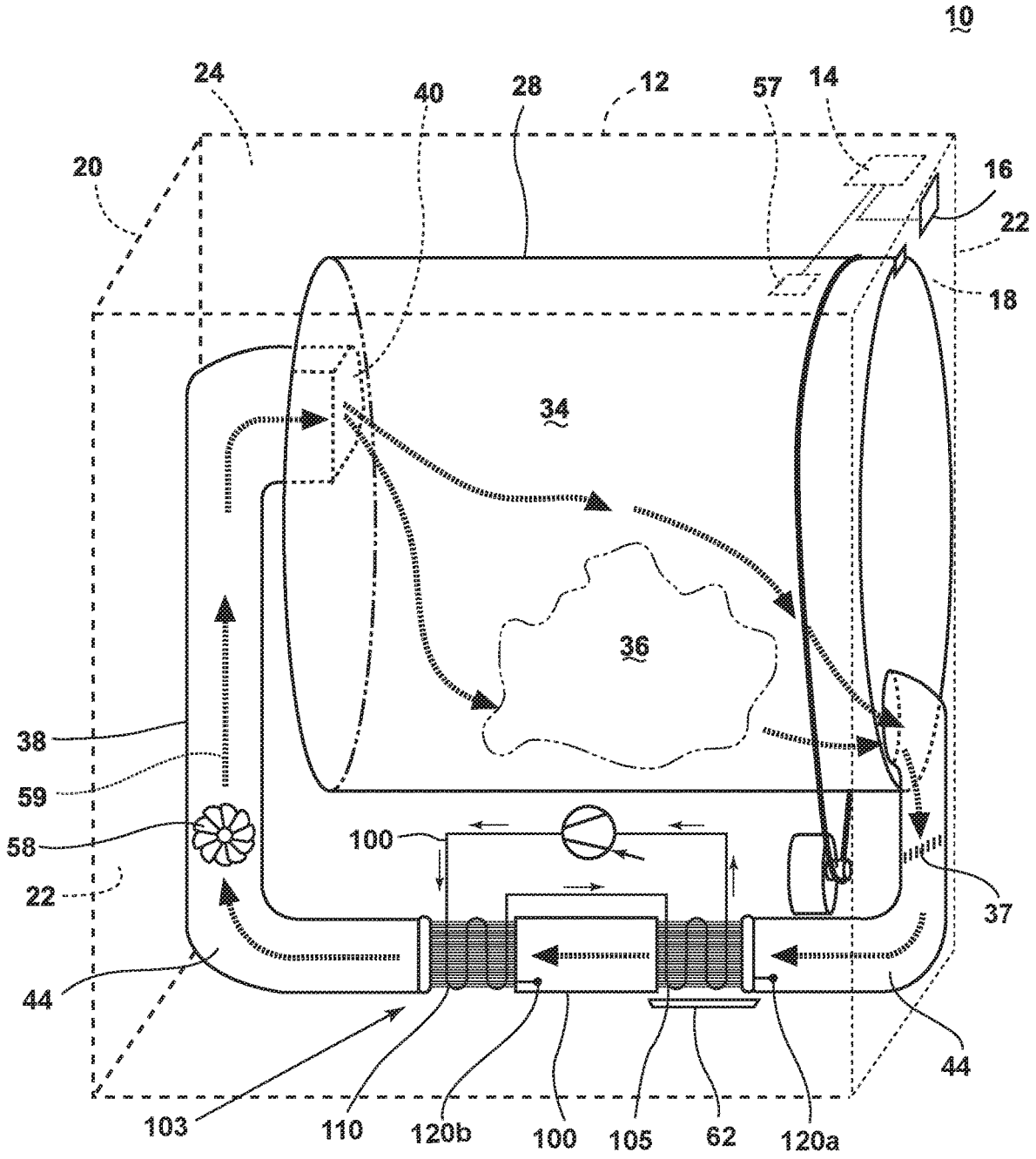
FIG. 1 is a schematic view of a heat pump clothes dryer according to one embodiment of the invention.

FIG. 1 is a schematic view of a laundry treating appliance in the form of a heat pump clothes dryer 10 according to an embodiment of the invention. The clothes dryer 10 of the illustrated embodiment may include a cabinet 12 defined by a front wall 18, a rear wall 20, a pair of side walls 22 and a supporting top wall 24. A control panel or user interface 16 may include one or more knobs, switches, displays, and the like for communicating with the user, such as to receive input and provide output. A controller 14 may receive input from a user through a user interface 16 for selecting a cycle of operation and controlling the operation of the heat pump clothes dryer 10 to implement the selected cycle of operation.

A rotatable drum 28 may be disposed within the interior of the cabinet 12 to define a treating chamber 34 for treating laundry 36.

Figure 2:
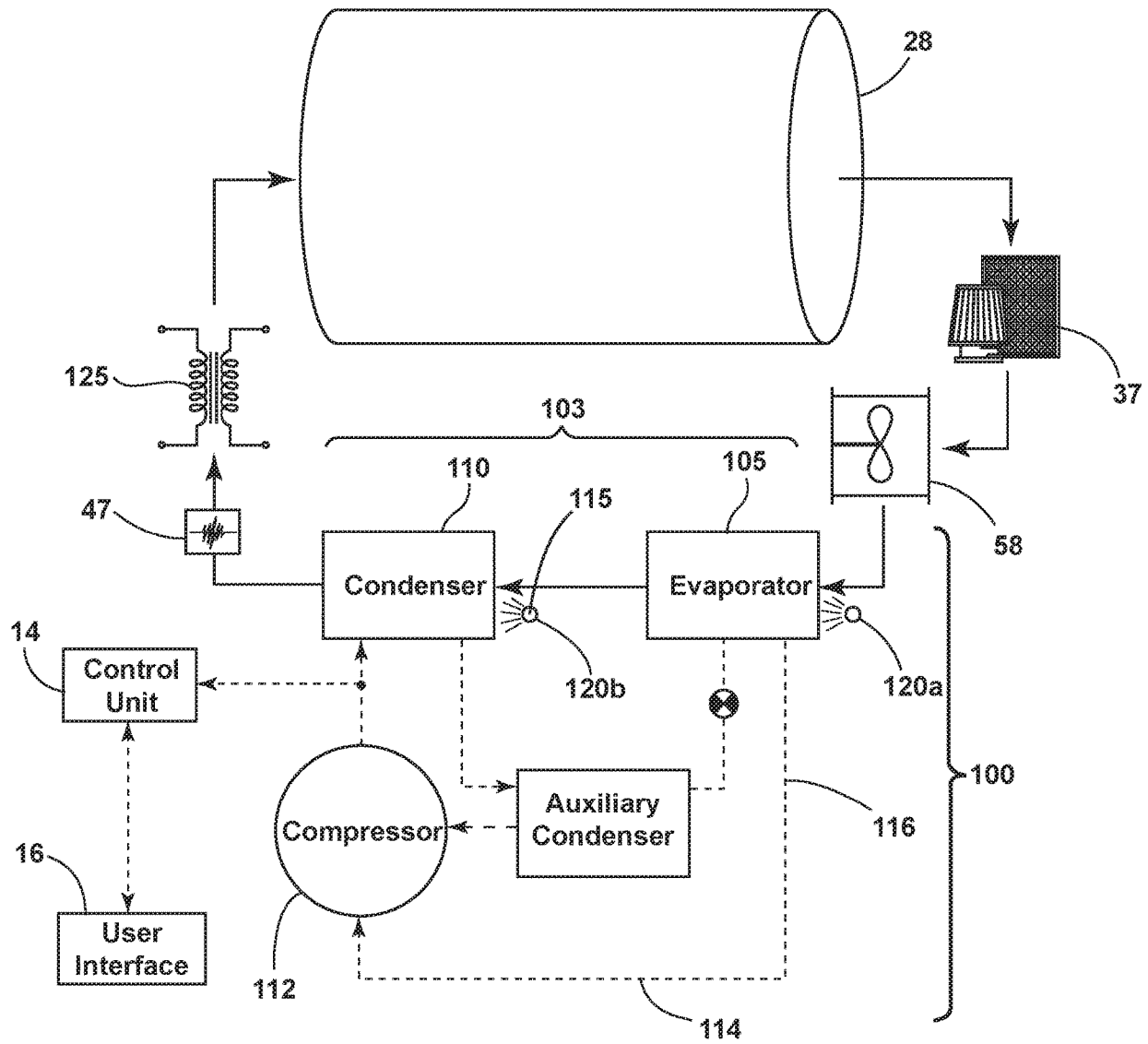
FIG. 2 is a schematic view of relevant components of a heat pump system of FIG. 1.

An air recirculation loop 38 is fluidly coupled to and recirculates air through the treating chamber 34. A recirculation loop air conduit 44 connects the drum 28 to a heat pump system 100 (FIG. 2). The heat pump system 100 contains a heat exchanger 103 comprising an evaporator 105 and a condenser 110. Under the evaporator 105 a condensate reservoir 62 collects condensed water from the recirculating air. A lint trap 37 may be provided at an inlet to the recirculation loop air conduit 44 from the treating chamber 34.

FIG. 2 is a schematic view of relevant components of a heat pump system 100 of a heat pump clothes dryer according to an embodiment of the invention. The heat pump system 100 involves a refrigerant loop 114 that with its phase variation, transfers heat to and from the recirculating air in the recirculation loop 38 by way of the heat exchanger 103. An expansion tube 116, evaporator 105, condenser 110, and compressor 112 comprise the refrigerant loop 114 to affect phase variation and transfer heat in the heat exchanger 103 of the recirculation loop. A blower 58 may be located within the air recirculation loop 38 and operably coupled to and controlled by the controller 14. For example, blower 38 may be located downstream of the drum 28 and upstream of the evaporator 105. In another example, blower 38 may be located downstream of the condenser 110 and upstream of the drum 28. An auxiliary heater 125 may lie within the air conduit 44 downstream of the condenser 110 and upstream of the drum 28 and may be operably coupled to and controlled by the controller 14.

Figure 5:
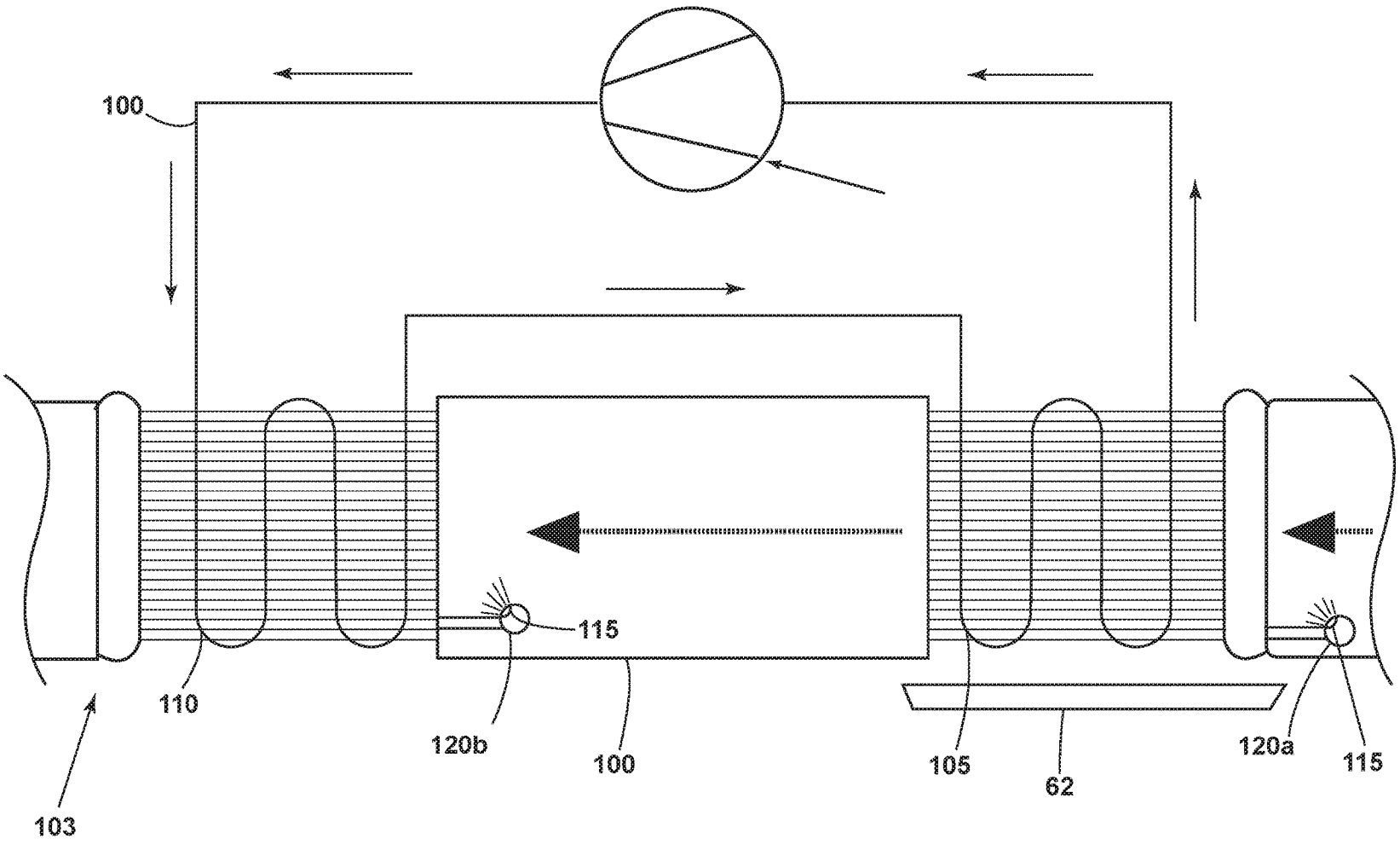
FIG. 5 shows an enlarged view of a portion of the schematic view of FIG. 1 with a spray assembly including atomizers.

The air recirculation loop 38 may further include a spray assembly 120. The spray assembly may be a nozzle or plurality of nozzles fluidly attached to a pump (not shown) and may include a 0 (not shown). The nozzles may include atomizers 115 for introducing atomized liquid into the recirculating air. (See FIG. 5, for example) Atomized liquid generally refers to droplets, a mist or a fine spray. Droplet size is often dictated by pressure, specific gravity, viscosity and other physical features in combination with the flow rate of the air and the liquid itself. Air flow influences the homogeneous distribution of the atomized liquid in the air. By way of example, an atomizer 115 may break up liquid into droplets having an average size of approximately 160 microns at a 20 psi water flow rate, though the scope of the present disclosure is not limited to these particular droplet sizes and pressure. By way of another example, an atomizer 115 may break up liquid into droplets of an average size that is able to be homogenously suspended in moving air at flow velocities of 140-160 CFM, though the scope of the present disclosure is not limited to these particular droplet sizes or flow velocities. The spray nozzles may be fixed or rotatable. Moreover, the number of nozzles may vary, as well as the height and positioning of each nozzle. Additionally, the shape, size, angle, arrangement and number of nozzles may vary as alternative arrangements may provide a more concentrated spray zone. For example, not only can the assembly be configured to provide water flow to a particular area, but the water flow may also be configured to have more speed or more volume per area. One example would be to use a nozzle or plurality of nozzles with a fan spray for coverage of the heat exchanger coils such as a BETE 05 120 Water Curtain, a BETE 08 120 Water Curtain, or a BEX Air Wisk Air Curtain, however, the scope of the present disclosure is not limited to these particular nozzles or spray patterns. The spray assembly 120 may be disposed in or adjacent to the airflow path and may be placed anywhere along the airflow path including inside the evaporator 105 or condenser 110.

FIG. 2 illustrates spray assemblies, 120*a* and 120*b*, at two exemplary spray assembly locations. In one embodiment, the spray assembly nozzle 120*a* is provided upstream of the evaporator 105 and configured to spray liquid toward or on to the evaporator 105. In this embodiment, spray assembly nozzle 120*a* may be used as a water wash system for the heat exchanger 103 to spray off, or clean, the evaporator 105 coils to periodically rinse away some or all the lint and debris that may accumulate on the evaporator coils from the recirculating air. While the spray assembly nozzle 120*a* is activated during a water wash process, the blower 58 may be activated to move the air and atomized liquid through the condenser 110, where it is heated, and into the drum 28, providing a steam or refresh cycle. Steam can generally refer to water in the vapor phase, and/or hot moist air with a mist of water that may visually appear like steam.

In conventional heat exchanger washing processes, the airflow is turned off during a heat exchanger rinsing process. In this embodiment, if the water wash system is at a high enough pressure and water flow velocity is adequate for a steam system, the airflow may be turned on during the heat exchanger wash process to provide air laden with water to the treatment chamber for steam or refresh cycles. In the prior art, for a dryer to have a water wash system for the heat exchanger as well as providing a separate steam cycle, multiple water systems were required inside the dryer. Multiple water systems inside a dryer amount to extra costs and parts associated with the dryer. Utilization of a water wash system for a heat exchanger that also provides for steam or refresh cycles as described herein has the advantage of eliminating the need for a water spray nozzle inside of the drum and the associated plumbing for the separate steam generating system, resulting in cost savings and increased appliance capacity.

In another embodiment, the spray assembly nozzle 120*b* is provided upstream of the condenser 110 and configured to spray on or toward the condenser 110. In this embodiment, when the spray assembly 120*b* is activated, the blower 58 may be activated to move the air and atomized liquid through the condenser 110, where it is heated, and into the drum 28, providing a steam or refresh cycle.

In one embodiment, the water is provided to the spray assembly 120 from a household supply. In another embodiment, the water is provided to the spray assembly 120 from the condensate reservoir 62. Liquid condensate may be drawn from the condensate reservoir 62 under the evaporator 105 and sprayed by the spray assembly 120 into the recirculation loop. In a further embodiment, the water is provided to the spray assembly 120 from both the condensate reservoir 62 and a household supply.

The spray assembly 120 may be at any location in the air recirculation loop such that atomized liquid is introduced into the air recirculation loop 38 prior to the heated air entering the drum 28.

In any embodiment, the air recirculation loop 38 may include an auxiliary heater 125 which may be optionally activated if additional heat is required.

Figure 3:
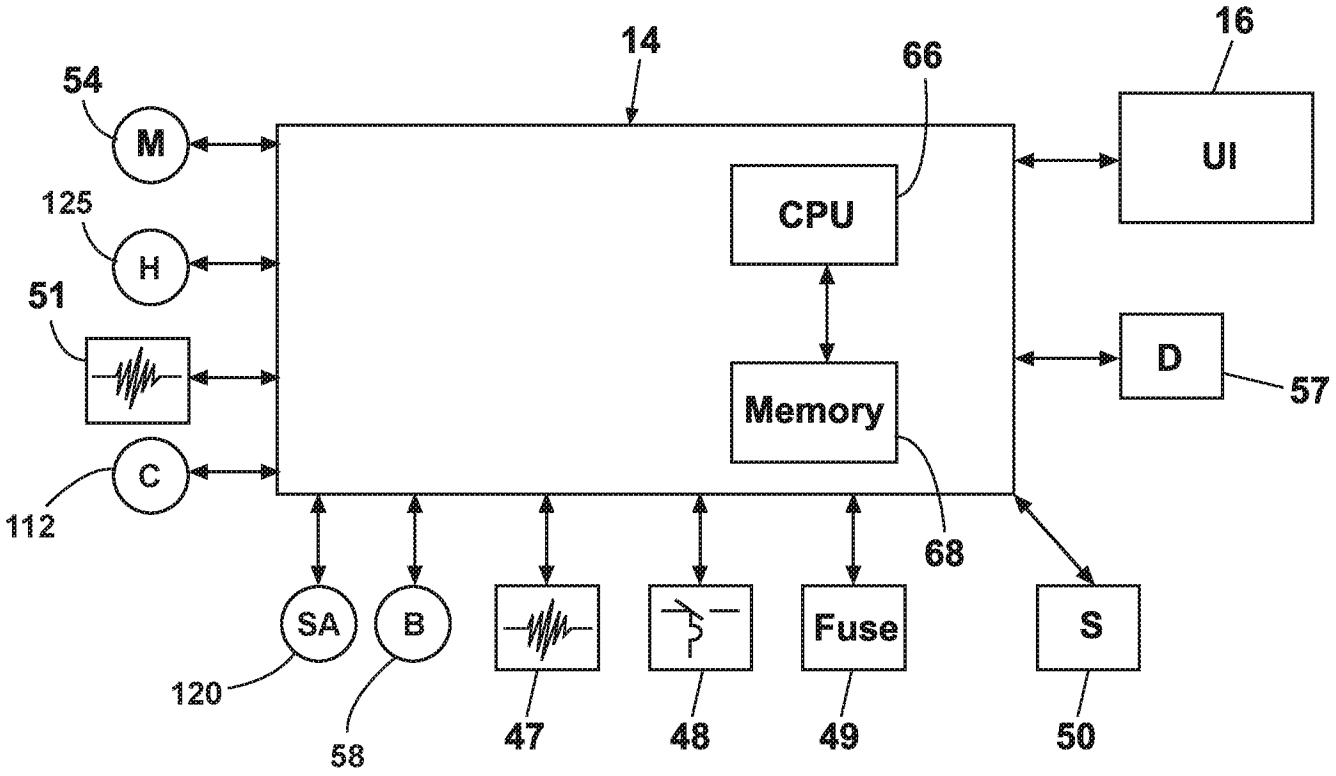
FIG. 3 is a schematic view of a controller of the heat pump clothes dryer in FIG. 1.

FIG. 3 is a schematic view of the controller 14 coupled to the various components of the dryer 10. The controller 14 may be communicably coupled to components of the clothes dryer 10 such as the auxiliary heater 125, blower 58, thermistor 47, thermostat 48, thermal fuse 49, thermistor 51, moisture sensor 50, motor 54, compressor 112, spray assembly 120, to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 enables the user to input commands to a controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans. By way of example, a Refresh cycle may be singly selected or as part of a treatment cycle by the user through the user interface 16 for dry laundry. The Refresh cycle may use water from a household supply to generate steam and may also heat to relax wrinkles and reduce odor from dry clothes. By way of another example, a dewrinkle cycle may be singly selected or as part of a treatment cycle by the user through the user interface 16 for wet laundry. The dewrinkle cycle may use water from the condensate reservoir 62 or water from a household supply, or both, to prevent wrinkles by periodically tumbling the laundry and adding steam to the drum 28 at the end of a drying cycle. The scope of the present disclosure is not limited to the exemplary treatment cycles herein.

The controller 14 may implement a treatment cycle selected by the user according to any options selected by the user and provide related information to the user. The controller 14 may also comprise a central processing unit (CPU) 66 and an associated memory 68 where various treatment cycles and associated data, such as look-up tables, may be stored. One or more software applications, such as an arrangement of executable commands/instructions may be stored in the memory and executed by the CPU 66 to implement the one or more treatment cycles.

In general, the controller 14 will effect a cycle of operation to effect a treating of the laundry in the treating chamber 34, which may or may not include drying. The controller 14 may actuate the blower 58 to move air in the air conduit 44 through the rear of the drum 28 to treating chamber 34 when air flow is needed for a selected treating cycle. As an option, if additional heat is needed, the controller 14 may activate auxiliary heater 125 to heat the air flow 59 as it passes over auxiliary heater 125, with the heated air 59 being supplied to the treating chamber 34. The thermistor 47 may sense the temperature of the inlet air that passes through the air conduit 44 and send to the controller 14 a signal indicative of the sensed temperature. The heated air 59 may be in contact with a laundry load 36 as it passes through the treating chamber 34 on its way to the air conduit 44 to effect a moisture removal of the laundry. The heated air 59 may exit the treating chamber 34, and flow into the air conduit 44 through the blower 58 and into the heat exchanger of the heat pump system 100 of heat pump clothes dryer 10. The controller 14 may activate the compressor 112 of the heat pump system 100. The moist hot recirculating air 59 may flow through the evaporator 105 of the heat pump system 100 where the refrigerant in the expansion tube 116 effects cooling of the recirculating air 59 to condense the moisture present in the air. The condensate from the cooled recirculating air 59 may be collected in the condensate reservoir 62 associated under the evaporator 105. The cooled recirculating air 59 may flow from the evaporator 105 into the condenser 110 where the refrigerant in the expansion tube 116 effects heating of the recirculating air. The recirculating air 59 may flow from the heat pump system 100 through the air conduit 44 and into the auxiliary heater 125 to complete one cycle of recirculating air.

The controller 14 continues the cycle of operation until completed. If the cycle of operation includes drying, the controller 14 determines when the laundry is dry. The determination of a "dry" load may be made in different ways, but is often based on the moisture content of the laundry, which is typically set by the user based on the selected cycle, an option to the selected cycle, or a user-defined preference.

A refresh or dewrinkle cycle may be provided to the treating chamber 34 as actuated by the controller 14 via input by the user through the user interface 16, or via stored treatment cycles in a central processing unit (CPU) 66 and an associated memory 68. In one embodiment, the controller 14 may activate spray assembly 120. Spray assembly nozzle 120*a* is provided upstream of the evaporator 105 and may introduce atomized liquid onto or toward the evaporator 105. The atomized liquid and cooled recirculating air then pass through the condenser 110. The condenser 110 heats the atomized liquid and air to a temperature sufficient to homogenously suspend the droplets in the air The blower 58 may draw the recirculated air containing atomized liquid into the treating chamber 34 to effect the dewrinkle cycle. In this embodiment, spray assembly nozzle 120*a* may introduce atomized liquid to spray off, or clean, the evaporator 105 coils to rinse away some or all the lint and debris that may accumulate on the evaporator coils from the recirculating air prior to the atomized liquid and cooled recirculating air passing through the condenser.

In another embodiment, the spray assembly nozzle 120*b* may introduce atomized liquid into the recirculation loop upstream of the condenser 110. The heat from the condenser 105 heats the atomized liquid and air. The blower 58 may draw the recirculated air containing atomized liquid into the treating chamber 34 to effect a steam/refresh cycle.

In any embodiment, the controller 14 may activate the auxiliary heater 125. The thermistor 47 may sense the temperature of the inlet air that passes through the air conduit 44 and send to the controller 14 a signal indicative of the sensed temperature. If the auxiliary heater 125 is turned on, the recirculated air and atomized liquid will be further heated prior to entering the treating chamber 34. The heater may emit an amount of heat to maintain the atomized liquid in homogenously suspended droplets in the air prior to introduction to the treating chamber 34 to effect a steam or refresh cycle.

Figure 4:
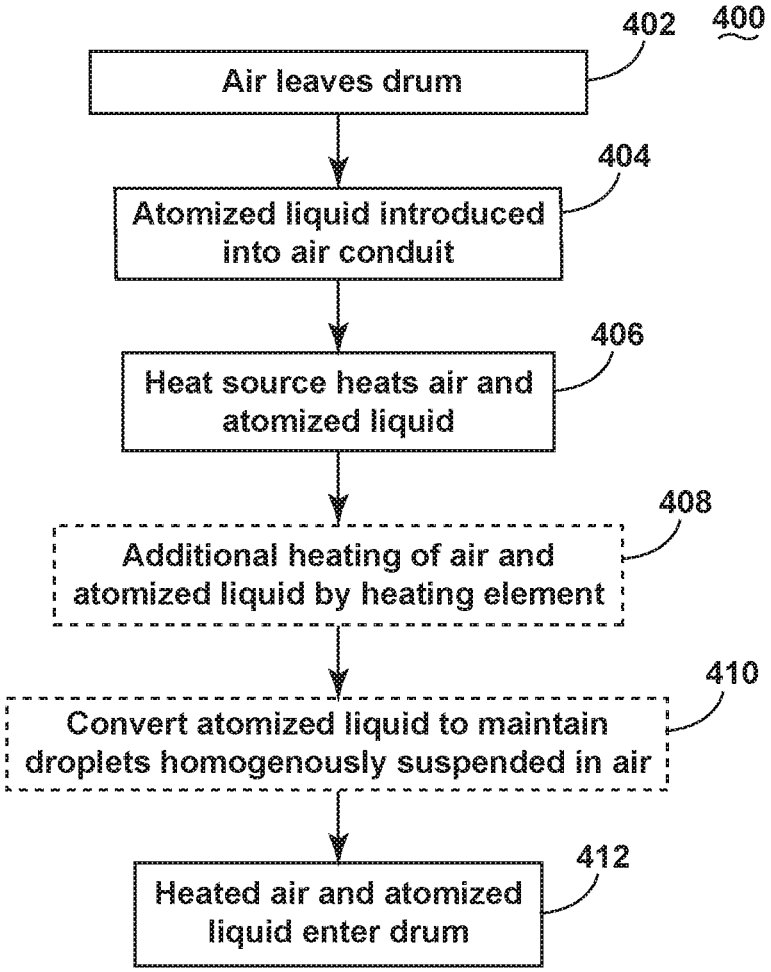
FIG. 4 is a flow chart illustrating a method according to an embodiment of the invention.

FIG. 4 is a flow-chart depicting a method of operating a laundry treating appliance with a steam cycle according to an embodiment of the invention. The sequence of steps depicted in FIG. 4 is for illustrative purposes only, and is not meant to limit the method in any way as it is understood that the steps may proceed in a different logical order, additional or intervening steps may be included, or described steps may be divided into multiple steps, without detracting from the invention. The method may be incorporated into a cycle of operation for the clothes dryer 10, such as prior to or as part of any phase of the treatment cycle. The method may also be a stand-alone cycle.

The method 400 may begin at 402 by starting a drying cycle. It is assumed that the drying cycle may be implemented with laundry inside the treating chamber 34. At 404, the blower 58 may recirculate air through the recirculation loop 38. At 406, atomized liquid may be introduced into the air recirculation loop 38 upstream of the heat source by spray assembly 120. At 406, the blower 58 may move the air to the heat source. The heat source may heat the air and atomized liquid. At 408 is an optional step of the air and atomized liquid passing through the auxiliary heater 125. At 410 is an additional optional step to maintain the atomized liquid homogenously suspended in the air prior to introduction to the drum 28. At 412, heated air and atomized liquid enter drum.

It will be understood that the invention is not limited to use with a heat pump dryer. Other types of dryers where process air is heated prior to flowing into the treatment chamber also allow for spraying atomized liquid into an air conduit upstream of the heat source so that process air laden with atomized liquid is heated prior to the process air entering the drum for the use in a steam/refresh cycle.

By way of example, in open loop heat pump dryer systems, although the exhaust is vented to the outside, the heat source for the process air is associated in the air conduit to allow for spraying atomized liquid upstream of the heat source prior to introduction into the drum to effect a steam/refresh cycle. And as explained above the atomized liquid can be introduced into the air conduit anywhere, preferably upstream of the heat source, including at the condenser or the evaporator.

By way of another example, in condenser dryer systems, humidity is removed by using two separate air flows. Air recirculates inside the machine and is heated by a heat source. The heated process air passes through the damp clothes where it picks up moisture. Moisture laden air passes through the condenser in one direction, while the room air passes through the condenser in the other direction. The moisture in the process air condenses into water which is then pumped to the water tank or out through the drain hose. In condenser dryer systems, both open and closed process air loop types, the heat source for the process air is associated in the air conduit to allow for spraying atomized liquid upstream of the heat source prior to introduction into the drum to effect a steam/refresh cycle.

By further example, a variable recirculation loop dryer system utilizes a valve system to form a closed recirculation loop for the process air until the process air reaches a programmed level of humidity before the valves open and the process air is directed to outside venting. In variable recirculation loop dryer systems, if the heat source for the process air is associated in the air conduit to allow for spraying atomized liquid upstream of the heat source prior to introduction into the drum to effect a steam/refresh cycle, the invention may be practiced.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method of operating a cycle of operation in a laundry treating appliance having a drum, an air conduit fluidly coupled to the drum, and a heat exchanger having an evaporator and a condenser associated with the air conduit, and an atomizer fluidly coupled to the air conduit, the method comprising:

spraying liquid at the evaporator from a spray nozzle located upstream of the evaporator;

moving air through the air conduit to the drum;

heating the moving air by operating the condenser;

introducing atomized liquid from the atomizer, into the air conduit upstream of the condenser and downstream of the evaporator such that the atomized liquid is suspended in the moving air and the condenser creates steam from the atomized liquid suspended in the moving air; and blowing the steam and moving air through the air conduit and into the drum to provide the steam into the drum to prevent wrinkling of laundry in the drum, wherein the blowing the steam and moving air through the air conduit and into the drum to provide the steam into the drum occurs during the cycle of operation.

2. The method of claim 1 wherein the introducing the atomized liquid comprises spraying the atomized liquid into the air conduit.

3. The method of claim 2 wherein the spraying the atomized liquid into the air conduit further comprises spraying the atomized liquid directly onto the condenser.

4. The method of claim 1 wherein the heating the atomized liquid comprises activating the condenser in the air conduit.

5. The method of claim 4 wherein the atomized liquid is delivered at a pressure of at least 20 PSI.

6. The method of claim 1 wherein introducing the atomized liquid comprises drawing liquid condensate from a condensate reservoir and introducing the liquid condensate in atomized form into the air conduit.

7. The method of claim 1 wherein introducing the atomized liquid comprises introducing the atomized liquid directly onto the condenser.

8. The method of claim 1 further comprising heating the atomized liquid downstream of the condenser.

9. The method of claim 1 wherein the atomized liquid is delivered at a pressure of at least 20 PSI.

10. The method of claim 1 wherein the step of blowing further comprises activating a blower while introducing the atomized liquid into the air conduit to blow the atomized liquid to the drum.

11. The method of claim 1 wherein the atomized liquid has an average size of 160 microns.

12. The method of claim 1 wherein the method includes operating a steam cycle of operation.

13. The method of claim 1 wherein the method includes operating a stand-alone steam cycle of operation.

14. The method of claim 1 wherein liquid sprayed at the evaporator from the spray nozzle located upstream of the evaporator cleans the evaporator.

15. The method of claim 1 wherein the atomizer is fluidly coupled to a second liquid nozzle.

16. The method of claim 1 wherein the cycle of operation is a steam cycle of operation.

17. A laundry treating appliance for operating a cycle of operation, the laundry treating appliance comprising:

a drum defining a treating chamber;

an air conduit fluidly coupled to the treating chamber;

a blower for forcing air through the air conduit;

a heat exchanger comprising an evaporator and a condenser associated with the air conduit;

a first liquid nozzle positioned upstream of the evaporator and directed at the evaporator; and a second liquid nozzle comprising an atomizer fluidly coupled to the air conduit upstream of the condenser and configured to spray atomized liquid into the air forced through the air conduit;

wherein heat from the condenser heats the atomized liquid to create steam before the air and the atomized liquid reaches the drum, and the blower forces the air and the atomized liquid through the air conduit into the drum to provide the steam into the drum during the cycle of operation to prevent wrinkling of laundry in the drum.

18. The laundry treating appliance of claim 17 wherein the atomizer emits the atomized liquid directly onto the condenser.

19. The laundry treating appliance of claim 17 further comprising a condensate reservoir associated with the evaporator and wherein the atomizer is fluidly coupled to the condensate reservoir.

20. The laundry treating appliance of claim 17 further comprising an auxiliary heater located downstream of the condenser and upstream of the drum.

21. The laundry treating appliance of claim 17, further comprising, wherein, in response to a selection to operate a steam cycle of operation, heat from the condenser heats the atomized liquid to create the steam before the air and the atomized liquid reaches the drum.

22. The laundry treating appliance of claim 17, further comprising, wherein, in response to a selection to operate a stand-alone steam cycle of operation, heat from the condenser heats the atomized liquid to create the steam before the air and the atomized liquid reaches the drum.

23. The laundry treating appliance of claim 17 wherein the atomized liquid has an average size of 160 microns.

24. The laundry treating appliance of claim 17 wherein the second liquid nozzle is located downstream of the evaporator.

25. The laundry treating appliance of claim 17 wherein the cycle of operation is a steam cycle of operation.

* * * * *